US005842932A

United States Patent [19]

Goddard

[11] Patent Number: 5,842,932

[45] Date of Patent: Dec. 1, 1998

[54] SIGHT FOR PUTTER TYPE GOLF CLUB

[76] Inventor: Frederic W. Goddard, 509 E. Montecito, #F, Santa Barbara, Calif. 93103

[21] Appl. No.: 892,451

[22] Filed: Jul. 14, 1997

[51] Int. Cl.[6] ..... A63B 69/36

[52] U.S. Cl. ..... 473/240; 473/252; 473/267; 473/268; 273/DIG. 30

[58] Field of Search ..... 473/240, 252, 473/253, 254, 267, 268; 273/DIG. 30

[56] References Cited

U.S. PATENT DOCUMENTS 2,463,200 3/1949 Pitzer ..... 473/240 X
3,548,504 12/1970 Sikes ..... 473/254 X
4,601,472 7/1986 O'Flanagan ..... 473/240

*Primary Examiner*—George J. Marlo
*Attorney, Agent, or Firm*—Timothy T. Tyson

[57] ABSTRACT

A practice sight (20) for a putter (26) is shown. The sight is attached to the top (60) and hosel (80) of the head (22). The sight has a planar mirror (44) at a 45° angle to the face (30) of the putter. Front and rear sight pins 46 and 48 attached to the base (52) of the sight in front of the mirror provide a reference for adjusting the attitude of the head. The golfer looks down at the mirror and sees the sight pins, a golf ball (26), and a golf ball hole (34) or flag. He lines up the putter head with the hole by rotating the head of the putter until the front sight pin disappears behind the rear sight pin while keeping the golf ball and hole in view in the mirror and centered on the center line of the mirror.

2 Claims, 4 Drawing Sheets

SIGHT FOR PUTTER TYPE GOLF CLUB

TECHNICAL FIELD

The present invention pertains to golf clubs, and in particular to a sight for a putter type of golf club.

BACKGROUND ART

Sights have been developed for aiding a golfer in practicing his putting form. During practice, the golfer looks at the sight as he holds the club to make sure he is holding it in the best manner. When he is actually playing golf, he either removes the sight or changes clubs while trying to maintain the manner of holding and swinging the club he learned during practice.

For example, putters having sights with mirrors attached at approximately 45° to horizontal on the putter heads are shown in U.S. Design Pat. Nos. 222,535; 245,438; and 245,439 and U.S. Utility Pat. Nos. 2,822,614; 2,898,109; 3,170,698; 3,507,500; and 4,953,866. The golfer holds the handle of the putter extended in his arms and sights down the handle shaft to the mirror which he rotates to line up the putter head with the golf ball and the hole. Further aids in the aligning process can be added to the mirrors. U.S. Pat. Nos. Des. 233,535; Des. 245,439; 2,898,109; and 3,170,698 have central vertical lines on their mirrors to aid in the aligning process. U.S. Pat. No. Des. 245,439 has a single sighting pin in front of the line for matching with the line. U.S. Pat. No. Des. 245,438 has a similar arrangement with a single sighting pin on either side of the central vertical line on the mirror. U.S. Pat. No. Des. 233,535 provides a thin wire between the face of the putter and the top of the mirror along the same plane as the central vertical line on the mirror. The object of each of the forward sighting elements is to make the putter head square with a golf ball by rotating the head until the forward element is between the central vertical line on the mirror and the golf ball.

After the golfer has finished practicing, he removes the sight for actual play or selects a different putter. Removable sights are shown in U.S. Pat. Nos. 2,822,614 and 2,898,109 which clamp to the putter shafts.

DISCLOSURE OF INVENTION

The present invention provides a sight for aiming a golf club and is particularly directed to putters. It aids the golfer in practicing to keep the club face square with the intended line of travel as well as allows actual aiming of the ball at the cup. Front and rear sight pins in conjunction with a mirror mounted on the putter head allow the golfer to look through the sight along the swing plane while putting.

In accordance with a preferred embodiment of the invention, the front sight pin is a bright color and the rear sight pin is a dull color. If the club head is properly aligned, the user will not see the bright colored front pin as it will be covered up by the dull colored pin. If the club head is not properly aligned, the bright colored front pin will be prominently displayed.

In accordance with an important feature of the invention, the bright colored front pin is red and the dull colored rear pin is black.

In accordance with a preferred embodiment of the present invention, the sight is easily attached to the club for practice and is easily removed for play allowing the golfer to become familiar with a single club instead of having separate clubs for practice and play.

In accordance with an important feature of the invention, the sight is held onto the club head by a hook and loop fastener means and onto the club hosel by a friction clip.

In accordance with an important aspect of the invention, the friction clip is coated with a rubber material to increase the friction between the clip and the hosel.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
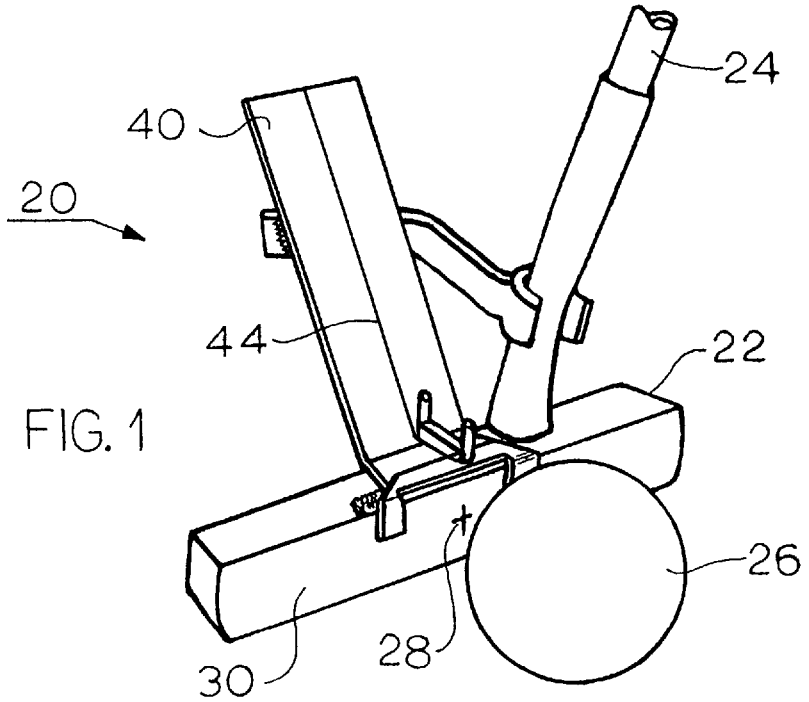
FIG. 1 is a top front right side perspective view of the sight mounted on a putter head behind a golf ball in accordance with the present invention.

Referring initially to FIG. 1, a top front right side perspective view of a sight is shown in accordance with the present invention, generally designated as 20, mounted on the head 22 of a putter 24. A golf ball 26 in front of the center 28 of the putter face 30 is ready to be struck.

Figure 2:
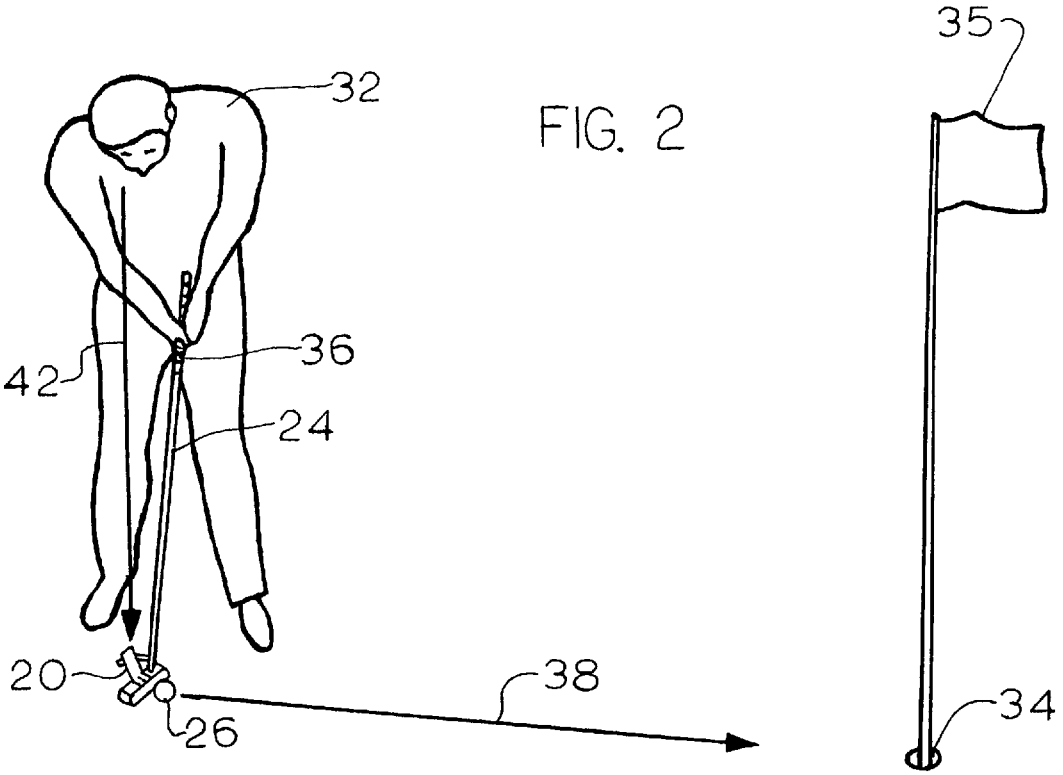
FIG. 2 is an environmental view showing a putter having the sight of FIG. 1 in use by a golfer to aim at a hole.

FIG. 2 is a reduced environmental view of FIG. 1 showing the putter 24 having the sight 20 in use by a golfer 32 to aim at a hole 34. The golfer holds the putter handle 36 and looks down at the ball 26 in the normal manner and positions the center 28 of the putter face 30 behind the ball as shown in FIG. 1.

If the golfer were not using the sight 20, the golfer would look up along the line 38 toward the hole 34 to determine the direction and distance to the hole. He would then make the putter face 30 perpendicular to the line 38, draw the putter head 22 back along the line while maintaining the face perpendicular to the line, and move the putter head forward along the line while maintaining the face perpendicular to the line to hit the ball with only enough force to gently ease it into the hole 34. The positions of his head, arms, hands, body, legs, and feet are all important in obtaining a proper result. One problem is that his eyes, which are his primary source of information regarding the direction, distance, and technique of hitting the ball, are located several feet from the ball and putter head. It is therefore difficult for him to determine exactly how he is moving the face of the putter head as he moves the putter along line 38.

The sight 20 provides a view to the golfer along line 38 instead of from several feet away. A flat mirror 40 mounted at 45° to the face 30 (FIG. 1) of the putter reflects the image along line 38 up to the eye of the golfer along a line 42. The golfer sees a view in the mirror over the top of the golf ball 26 to the hole 34 and flag 35. He can make the putter face 30 perpendicular to the line 38 between the ball and the hole by aligning a center line 44 on the mirror 40 and the sight pins 46 and 48 (FIG. 3) with the ball and the hole. The center line 44 is made on mirror 40 in a plane perpendicular to the face 30 of the putter head and passing through the center 28 of the face.

Figure 3:
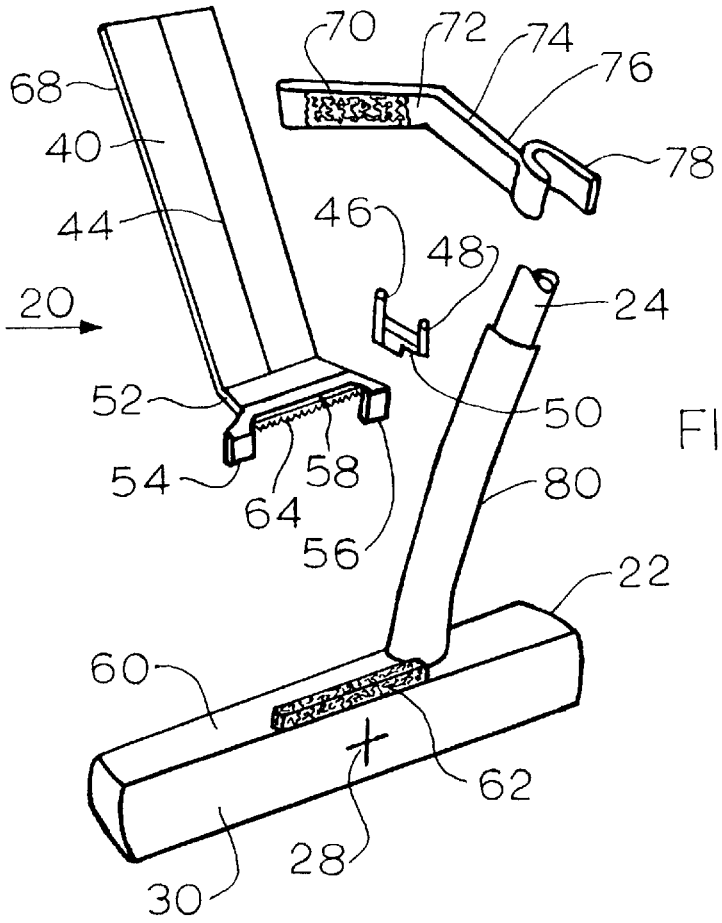
FIG. 3 is an exploded perspective view of FIG. 1 without the golf ball.

FIG. 3 is an exploded perspective view of the sight 20 of FIG. 1 without a golf ball. Two sight pins 46 and 48 on a pin assembly 50 are mounted on a base 52 of sight 20 in line with the center line 44 on the mirror 40. Pin assembly 50 is preferably fabricated of metal such as aluminum having a thickness of 0.093 inches while mirror 40 and base 52 are fabricated of a single piece of metal such as polished aluminum having a thickness of 0.030 inches. Two base indices 54 and 56 at the front 58 of base 52 together with base 52 provide a means for registering the sight 20 on the putter head 22. The base 52 is flat and sits on the flat top 60 of the putter head 22. The base 52 is perpendicular to the face 30 of the putter head while the two base indices 54 and 56 are in the plane of the face perpendicular to the base 52.

Sight 20 is easily mounted on any standard smooth topped putter 24 using two sets of hook and loop fastener means such as sold under the trademark Velcro. The first fastener has one portion, preferably a loop portion 62, attached along the top 60 of the putter head 22 adjacent the front face 30 in the center 28. The other corresponding portion, preferably a hook portion 64, is attached under the front 58 of base 52 of the sight 20. The second fastener has one portion, preferably a loop portion 66 (FIG. 5), attached along the back 68 of the mirror 40. The other corresponding portion, preferably a hook portion 70, is attached to the front 72 of the arm 74 of back support mount 76.

Sight 20 is attached to putter head 22 by pressing clip 78 of back support mount 76 onto the hosel 80 of the club head and swiveling it to the approximate desired location. The two base indices 54 and 56 on base 52 are touched to the top of face 30 equidistant from center 28 of the face and the base is rotated down so that hook portion 64 engages loop portion 62 with sight pins 46 and 48 in line with the center 28. The mirror 40 is moved toward the back support mount 76 so that loop portion 66 engages hook portion 70 on the back support mount with mirror 40 at about a 45° angle to the face 30 of the putter head 22. The position of the mirror with respect to the face can be adjusted slightly left and right by rotating the clip around the hosel until both of the two base indices 54 and 56 touch the face. The angle of the mirror with respect to the face can be adjusted slightly by raising or lowering the clip 78 on the hosel until the base of the sight touches the top of the putter head. The sight is thereby registered with the face of the putter head and is ready for use.

After the golfer has finished practicing with the sight 20, it is easily removed from the putter 24 by pulling clip 78 off of hosel 80 and lifting the front 58 of the sight off of putter head 22. A small portion of fastener 62 remains on the head which normally is not a problem. It too is easily removed if desired.

Figure 4:
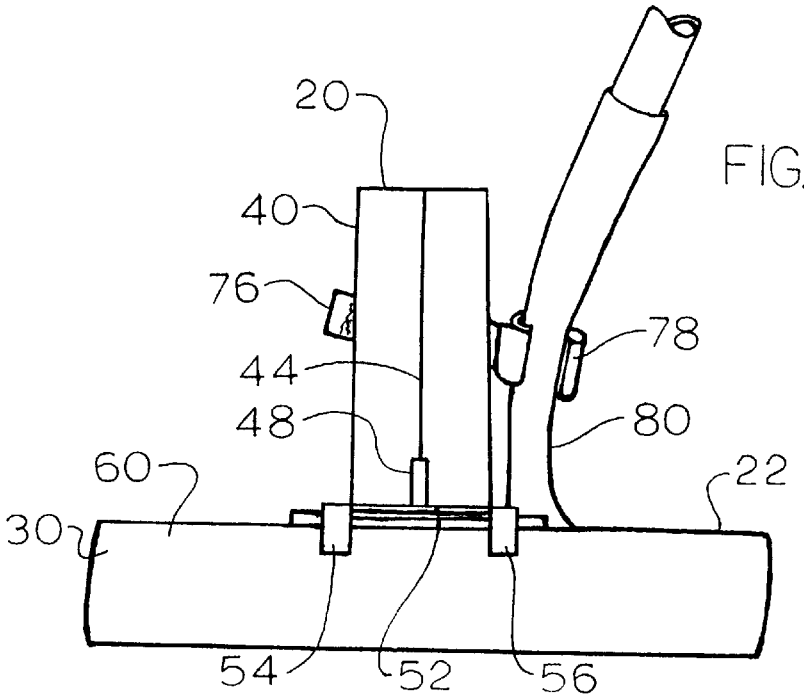
FIG. 4 is a front elevational view of FIG. 1 without the golf ball.

FIG. 4 is a front elevational view of FIG. 1 without the golf ball. Sight 20 has been attached to putter head 22 in the manner described above in conjunction with FIG. 3. Clip 78 is around hosel 80 holding back support mount 76 which in turn supports mirror 40. Base indices 54 and 56 abut front face 30 and base 52 touches top 60 aligning sight 20 with the putter face 30. Sight pin 46 (FIG. 3) cannot be seen in FIG. 4 because it is hidden behind sight pin 48. If the viewer of FIG. 4 were at the hole 34 of FIG. 2, putter 24 would be correctly aimed at the hole with face 30 perpendicular to line 38 (FIG. 2).

Figure 5:
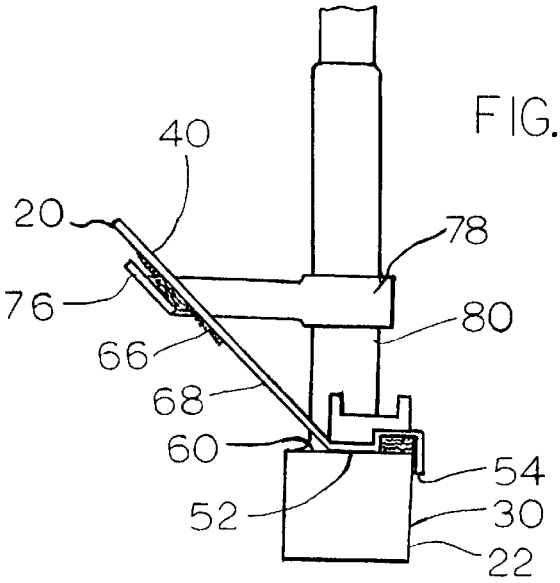
FIG. 5 is a side elevational view of FIG. 4.

FIG. 5 is a side elevational view of FIG. 4 showing how sight 20 registers with head 22 to place the plane of mirror 40 precisely at a predetermined angle with respect to the plane of the face 30. The preferred angle is 45° but other angles are possible by adjusting the mirror back 68 on the back support mount 76 or the clip 78 on the hosel 80. When base 52 touches the flat top 60 of head 22 and base indices 54 and 56 (FIG. 4) touch face 30, the sight 20 is properly aligned with head 22 allowing the golfer 32 (FIG. 2) to look down along line 42 at the mirror 40 and see the hole 34 and flag 35 along line 38 with the face 30 of the putter square with line 38.

Figure 6:
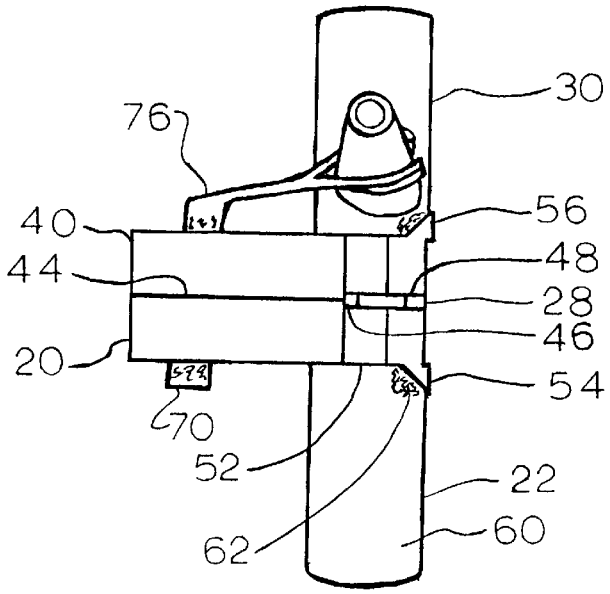
FIG. 6 is a top plan view of FIG. 4.

FIG. 6 is a top plan view of FIG. 4 showing the top 60 of putter head 22 and sight 20 as it would be seen by the golfer 32 (FIG. 2) along line 42. When sight 20 is registered on head 22, base 52 touches top 60 and base indices 54 and 56 touch face 30. This makes center line 44 on mirror 40 perpendicular to the plane of putter face 30. The center line 44 can be adjusted to match the center 28 (FIG. 1) of head 22 by moving the mirror and base portion along the head before securing it to the loop portion 62 on the head and the hook portion 70 on the back support mount 76.

Sight pins 46 and 48 provide an added dimension to sight 20 that is not available in prior sights. Prior sights have had center lines on mirrors that are perpendicular to the face of the putters. When a sight having only a center line on a mirror is used, the golfer tries to line up the center line with the line from the golf ball to the hole, e.g. line 38 in FIG. 2. This is difficult particularly from the distance of several feet from the putter head to the eye of the golfer. The sight pins 46 and 48 of the present invention are much more visible to a golfer from the distance of several feet required than is a mere center line. The sight pins 46 and 48 are substantially the same size. When the club head is perfectly aligned with the ball and hole along line 38 (FIG. 2), the front pin 48 visually disappears behind the back pin 46 from the point of view of the golfer along line 42. This effect is enhanced by coloring front pin 48 with a bright color such as red. Then when the putter head 22 is out of alignment, the golfer can see the red front pin 48 clearly in the mirror 40. Only when the putter is in perfect alignment with the ball and hole will the redness of the front pin 48 be hidden by the rear pin 46.

Figures 7, 8, 9:
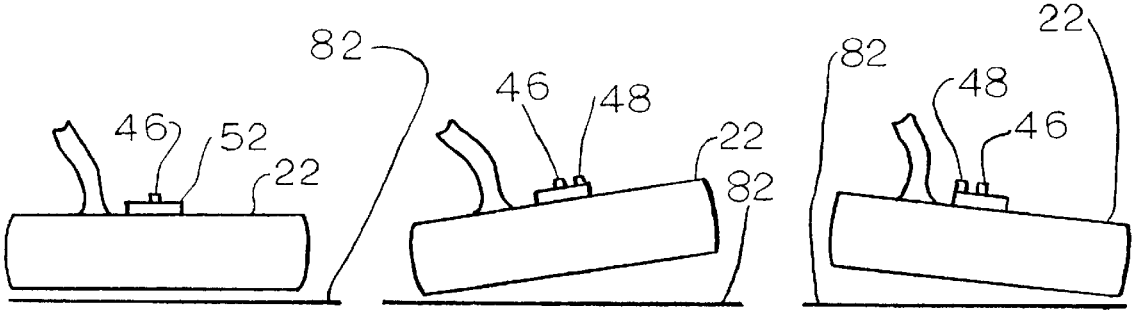
FIG. 7 is a reduced rear elevational view of FIG. 4 with the mirror and back support mount removed and the club head level with the ground.
FIG. 8 is a reduced rear elevational view similar to FIG. 7 with the club heel grounded.
FIG. 9 is a reduced rear elevational view similar to FIG. 7 with the club toe grounded.

FIG. 7 is a reduced rear elevational view of FIG. 4 with the mirror and back support mount removed and the club head 22 level with the ground 82. Rear sight pin 46 completely hides the front sight pin so that it appears that there is only one pin on the base 52 of head 22. The view of the pin is the same as a golfer would see in the mirror along line 42 shown in FIG. 2. If the head were rotated slightly to the left, the red pin 48 (FIG. 5) would appear to the left. If the head were rotated slightly to the right, the red pin would appear to the right. If the head were tilted slightly up, the red pin would appear above the rear pin 46. Thus, the sight pins provide ready indications of the misalignment of the head to the left or right and up and down when the head is level with the ground 82. In order to achieve the view of FIG. 7, the viewer has to get down to the level of the club head 22 and look across the top of the head.

FIGS. 8 and 9 are similar to FIG. 7 and show how the pins appear in the mirror 40 to the golfer 32 (FIG. 2) when the head 22 is not level to the ground 82. When the club is moved so that its heel is grounded as shown in FIG. 8, the rear sight pin 46 moves to the left of the red forward sight pin 48 in the mirror. When the club is moved so that its toe is grounded as shown in FIG. 9, the rear sight pin 46 moves to the right of the red forward sight pin 48 in the mirror. This same perspective phenomenon can be observed by moving two fingers, one placed in front of the other, in front of the eye while observing a distant object over the two fingers. The nearer finger appears to move farther than the further finger as the fingers are moved from side to side. This perspective phenomenon between two moving pins is used in the present invention to provide information to the golfer of even the slightest misalignment of the putter head.

With a little practice, the golfer can easily move the club to a level position square on the line 38 shown in FIG. 2 using the sight pins 46 and 48. The golfer can then make a practice swing away from and toward the golf ball 26 without actually hitting it to check his swing. The view in the mirror should not change substantially during the movement. If the golfer puts a small arc in the putting stroke, the ball and target hole or flag will move slightly up and down the center line 44 during the swing. If the golfer moves the putter parallel to the ground, the ball and target hole or flag will get slightly smaller and larger during the swing. Once the golfer has the proper stroke developed, he can hit the ball into the hole.

Figure 10:
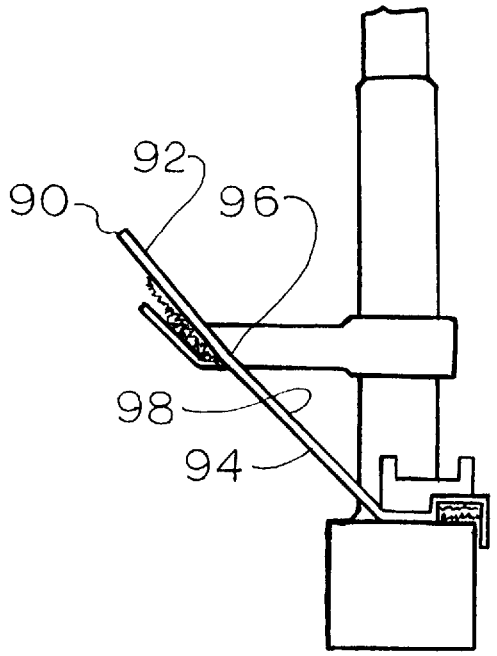
FIG. 10 is a side elevational view of a second embodiment having a two part mirror similar to FIG. 5; and, FIG. 11 is a side elevational view of a third embodiment permanently attached to the club head similar to FIG. 5.

FIG. 10 is a side elevational view of a second embodiment 90 of a sight having a two part mirror similar to FIG. 5. All elements of sight 90 are the same as on sight 20 except that the upper portion 92 of the mirror 94 is bent slightly forward at 96 from the plane of the lower portion 98. This allows the golfer to see further objects in the upper portion while simultaneously seeing closer objects in the lower portion. The plane of the lower portion 98 is preferably set at 45° to the front face 30 as in the previous embodiment while the plane of the upper portion is a few degrees less such as 41°.

Figure 11:
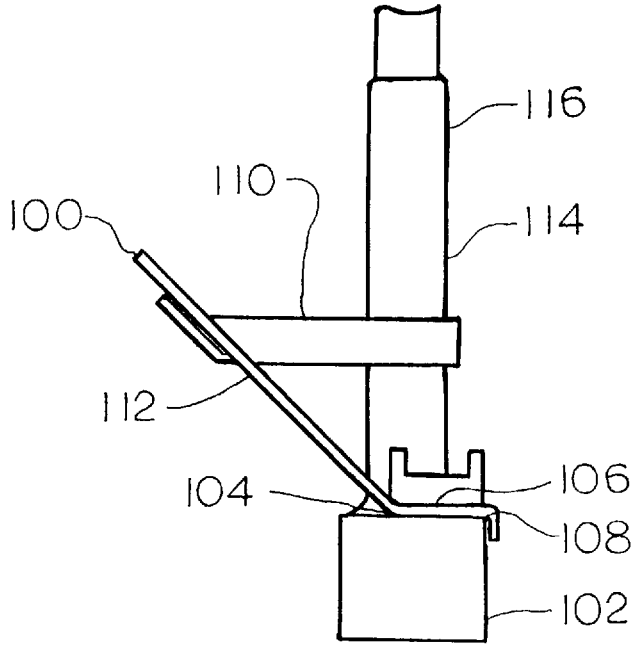

FIG. 11 is a side elevational view of a third embodiment 100 of a sight permanently attached to a club head 102 similar to FIG. 5. All elements of sight 100 are the same as on sight 20 in FIG. 5 except that adhesive 104 attaches the base 106 to the club top 108 replacing the hook and loop fastener means, and the back support mount 110 is permanently attached to the mirror 112 and hosel 114 of the club 116. Other attaching means such as screws and clamps may also be used.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A sight for a golf club having a club head with a face and a top, comprising:

a base for placement on the club top;

a planar mirror coupled to said base at an angle;

front and rear sight pins coupled to said base in front of said mirror in a plane perpendicular to the plane of said mirror, said rear sight pin spaced from said mirror, and said front sight pin spaced from said rear sight pin in front of said rear sight pin; and, means for removably coupling said sight to the club head including:

a hook and loop fastener means having a portion on said base and a portion for application to the club head;

a back support mount having a clip for application to the hosel of the golf club; and, said hook and loop fastener means having a portion on said mirror and a portion on said back support mount.

2. A sight for a golf club having a club head with a face and a top, comprising:

a base for placement on the club top;

a planar mirror coupled to said base at an angle;

front and rear sight pins coupled to said base in front of said mirror in a plane perpendicular to the plane of said mirror, said rear sight pin spaced from said mirror, and said front sight pin spaced from said rear sight pin in front of said rear sight pin; and, an upper mirror portion coupled to the top of said planar mirror at an angle to said base greater than the angle at which said mirror is coupled to said base.

* * * * *